US011663943B2

(12) United States Patent
Huang

(10) Patent No.: US 11,663,943 B2
(45) Date of Patent: May 30, 2023

(54) DRIVE CIRCUIT AND DISPLAY PANEL

(71) Applicant: HKC CORPORATION LIMITED, Guangdong (CN)

(72) Inventor: Xiaoyu Huang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/270,203

(22) PCT Filed: Dec. 5, 2018

(86) PCT No.: PCT/CN2018/119272
§ 371 (c)(1),
(2) Date: Feb. 22, 2021

(87) PCT Pub. No.: WO2020/103193
PCT Pub. Date: May 28, 2020

(65) Prior Publication Data

US 2021/0319732 A1 Oct. 14, 2021

(30) Foreign Application Priority Data

Nov. 21, 2018 (CN) ..... 201811392320.0

(51) Int. Cl.
*G09G 3/36* (2006.01)
*G09G 3/325* (2016.01)
(Continued)

(52) U.S. Cl.
CPC ..... *G09G 3/006* (2013.01); *G09G 3/3696* (2013.01); *G09G 2320/043* (2013.01); *G09G 2330/12* (2013.01)

(58) Field of Classification Search
CPC ..... G09G 3/006; G09G 3/3696; G09G 2320/043; G09G 2330/12
See application file for complete search history.

(56) References Cited

U.S. PATENT DOCUMENTS 9,959,800 B1 * 5/2018 Zhang ..... G09G 3/3696
2009/0302903 A1 * 12/2009 Woo ..... G09G 3/3696 327/143

(Continued)

FOREIGN PATENT DOCUMENTS

CN 1566980 A 1/2005
CN 101527305 A 9/2009

(Continued)

OTHER PUBLICATIONS

International Search Report, dated Aug. 20, 2019, for HKC Corporation Limited, International Application No. PCT/CN2018/119272, filed Dec. 5, 2018.

(Continued)

*Primary Examiner* — Lin Li
(74) *Attorney, Agent, or Firm* — Law Offices of Albert Wai-Kit Chan, PLLC

(57) ABSTRACT

A driver circuit and a display panel. The driver circuit comprises a driver chip (100), a detection signal generation circuit (200), and a feedback circuit (300). The detection signal generation circuit (200) is used for generating a detection control signal for performing aging detection according to the received first voltage signal and second voltage signal. The feedback circuit (300) is used for generating a feedback voltage and outputting same to the driver chip (100) according to the detection control signal and an working voltage, so that the driver chip (100) adjusts the outputted working voltage to a voltage required for performing the aging detection according to the feedback voltage, so as to satisfy the requirement for the diversity of voltage required for the voltage for the aging detection in the process of aging detection.

2 Claims, 4 Drawing Sheets

(51) Int. Cl.
*G09G 3/00* (2006.01)
*H05B 33/08* (2020.01)

(56) References Cited

U.S. PATENT DOCUMENTS

| | | | | |
|---|---|---|---|---|
| 2010/0033110 | A1 | 2/2010 | Chien | |
| 2016/0104411 | A1* | 4/2016 | Nathan | G09G 3/3233 345/77 |
| 2017/0124957 | A1* | 5/2017 | Ahn | G09G 3/325 |
| 2018/0373094 | A1* | 12/2018 | Ryoo | H05B 45/46 |
| 2019/0206338 | A1* | 7/2019 | Li | G05F 1/10 |

FOREIGN PATENT DOCUMENTS

| | | | | | |
|---|---|---|---|---|---|
| CN | 102857099 | A | * | 1/2013 | H02M 3/156 |
| CN | 203085128 | U | | 7/2013 | |
| CN | 203691242 | U | | 7/2014 | |
| CN | 104361859 | A | | 2/2015 | |
| CN | 105511546 | | * | 4/2016 | G09G 3/3607 |
| CN | 105511546 | A | * | 4/2016 | G09G 3/006 |
| CN | 206413225 | U | * | 8/2017 | H05B 33/08 |
| CN | 107393481 | A | | 11/2017 | |
| CN | 108073213 | A | | 5/2018 | |
| WO | WO 2020/043134 | A1 | * | 1/2019 | H03M 1/1009 |

OTHER PUBLICATIONS

Written Opinion of the International Search Authority, dated Aug. 20, 2019, for HKC Corporation Limited, International Application No. PCT/CN2018/119272, filed Dec. 5, 2018.

Chinese Office Action, dated Mar. 5, 2020, for HKC Corporation Limited, Chinese Application No. 201811392320.0, filed Nov. 21, 2018.

Chinese Office Action, dated Jun. 30, 2020, for HKC Corporation Limited, Chinese Application No. 201811392320.0, filed Nov. 21, 2018.

* cited by examiner

DRIVE CIRCUIT AND DISPLAY PANEL

CROSS-REFERENCE TO RELATED APPLICATIONS

This application is the national stage of International Application with No. PCT/CN2018/119272, filed on Dec. 5, 2018, which claims priority to Chinese Patent Application No. 201811392320.0, filed on Nov. 21, 2018, entitled "Drive Circuit and Display Panel", the entire content of which is hereby incorporated by reference.

TECHNICAL FIELD

The present disclosure relates to the technical field of display, in particular to a drive circuit and a display panel.

BACKGROUND

The statement herein only provides background information related to this application and does not necessarily constitute prior art. Thin Film Transistor Liquid Crystal Display (TFT-LCD) panel is one of the main flat panel display products, and has become an important display platform in modern information technology industry and video products. During the working process of the TFT-LCD display panel, power supply and signals are provided to the display area mainly through the drive chip on the printed circuit board, thus to realize image display.

In the production process, an aging detection is usually carried out after the display panel is manufactured. The aging detection is mainly used for detecting whether there are problems such as liquid crystal cell line defects, slight damages to electronic components and the like. When users using the display panel, those problems easily lead to defects of the display panel, such as wire breakage, corrosion and the like, and seriously affect the quality of the product. However, the conventional aging detection design cannot meet the customers' demand for the diversity of voltages used in the aging detection process.

SUMMARY

Based on the above, the present application provides a drive circuit and a display panel to solve the situation that the diversity requirements of customers for voltages required for an aging detection cannot be met.

An embodiment of that present application provides a drive circuit including:

a drive chip for outputting a working voltage;

a detection signal generation circuit for receiving a first voltage signal and a second voltage signal, and generating a detection control signal for performing an aging detection according to the first voltage signal and the second voltage signal; and a feedback circuit, a first input terminal of the feedback circuit being electrically connected with a voltage output terminal of the drive chip, a second input terminal of the feedback circuit being electrically connected with an output terminal of the detection signal generation circuit, and a first output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage.

In one embodiment, the detection signal generation circuit includes:

a voltage input branch for receiving the first voltage signal and the second voltage signal; and a judgment branch electrically connected with the voltage input branch, wherein the first voltage signal and the second voltage signal are input to the judgment branch through the voltage input branch, and the judgment branch generates the detection control signal according to the first voltage signal and the second voltage signal.

In one embodiment, the voltage input branch includes:

a first signal input terminal electrically connected with the judgment branch;

a second signal input terminal electrically connected with the judgment branch and the first signal input terminal; and a first resistor, one terminal of the first resistor being electrically connected with the first signal input terminal, and another terminal of the first resistor being electrically connected with the second signal input terminal.

In one embodiment, the judgment branch includes a comparator, a positive input terminal of the comparator is electrically connected with the first signal input terminal, the negative input terminal of the comparator is electrically connected with the first resistor and the second signal input terminal, and a comparison signal output terminal of the comparator is electrically connected with the first input terminal of the feedback circuit.

In one embodiment, the feedback circuit includes:

an adjustment branch electrically connected with the voltage output terminal of the drive chip through the first input terminal of the feedback circuit, and electrically connected with the feedback voltage input terminal of the drive chip through the first output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the comparison signal output terminal of the comparator, a second input terminal of the switch branch being electrically connected with the adjustment branch through the second output terminal of the adjustment branch, and an output terminal of the switch branch being electrically connected with the feedback voltage input terminal of the drive circuit and the first output terminal of the feedback circuit, the switch branch is configured for receiving the detection control signal and controlling the feedback voltage output by the adjustment branch according to the detection control signal.

In one embodiment, the switch branch includes a switch tube, a gate of the switch tube is electrically connected with the comparison signal output terminal of the comparator, a drain of the switch tube is electrically connected with the feedback voltage input terminal of the drive chip and the first output terminal of the feedback circuit, and a source of the switch tube is electrically connected with the second output terminal of the adjustment branch.

In one embodiment, the adjustment branch includes:

a second resistor, one terminal of the second resistor being electrically connected with the feedback voltage input terminal of the drive chip, and another terminal of the second resistor being grounded;

a third resistor, one terminal of the third resistor being electrically connected with the voltage output terminal of the drive chip, and another terminal of the third resistor being electrically connected with the second resistor, the feedback voltage output terminal of the drive chip and the drain of the switch tube; and a fourth resistor, one terminal of the fourth resistor being electrically connected with the source of the switch tube, and another terminal of the fourth resistor being electrically connected with the voltage output terminal of the drive chip and the third resistor.

In one embodiment, the first voltage signal is a high level voltage signal and the second voltage signal is a low level voltage signal.

In one embodiment, the switch tube is a P-type switch tube.

In one embodiment, the switch tube is a triode or a field effect transistor.

In one embodiment, the switch branch includes:

an inverter, an input terminal being electrically connected with the comparison signal output terminal of the comparator, and an output terminal being connected with the gate of the switch tube; and a switch tube, a gate of the switch tube is electrically connected with the output terminal of the inverter, a source of the switch tube is electrically connected with the feedback voltage input terminal of the drive chip and the first output terminal of the feedback circuit, and a drain of the switch tube being electrically connected with the second output terminal of the adjustment branch.

In one embodiment, the adjustment branch includes:

a second resistor, one terminal of the second resistor being electrically connected with the feedback voltage input terminal of the drive chip, and another terminal of the second resistor being grounded;

a third resistor, one terminal of the third resistor being electrically connected with the voltage output terminal of the drive chip, and another terminal of the third resistor being electrically connected with the second resistor, the feedback voltage output terminal of the drive chip and the source of the switch tube; and a fourth resistor, one terminal of the fourth resistor being electrically connected with the drain of the switch tube, and another terminal of the fourth resistor being electrically connected with the voltage output terminal of the drive chip and the third resistor.

In one embodiment, the first voltage signal is a high level voltage signal, the second voltage signal is a low level voltage signal, and the switch tube is an N-type switch tube.

Based on a same inventive concept, an embodiment of the present application provides a display panel including:

a display area for displaying according to a drive signal, and a peripheral circuit area electrically connected with the display area for supplying power to the display area and providing the drive signal;

wherein the peripheral circuit area includes a driving circuit, the driving circuit includes:

a drive chip for outputting a working voltage;

a detection signal generation circuit for receiving a first voltage signal and a second voltage signal, and generating a detection control signal for performing an aging detection according to the first voltage signal and the second voltage signal; and a feedback circuit, a first input terminal of the feedback circuit being electrically connected with a voltage output terminal of the drive chip, a second input terminal of the feedback circuit being electrically connected with an output terminal of the detection signal generation circuit, and a first output terminal of the feedback circuit being electrically connected with a feedback voltage input terminal of the drive chip, the feedback circuit being configured for receiving the detection control signal output by the detection signal generation circuit and the working voltage provided by the drive chip, generating a feedback voltage according to the detection control signal and the working voltage and output the feedback voltage to the drive chip, thereby the drive chip adjusting the working voltage to a voltage required for the aging detection according to the feedback voltage.

In one embodiment, the detection signal generation circuit includes:

a voltage input branch for receiving the first voltage signal and the second voltage signal; and a judgment branch electrically connected with the voltage input branch, wherein the first voltage signal and the second voltage signal are input to the judgment branch through the voltage input branch, and the judgment branch generates the detection control signal according to the first voltage signal and the second voltage signal.

In one embodiment, the voltage input branch includes:

a first signal input terminal electrically connected with the judgment branch;

a second signal input terminal electrically connected with the judgment branch and the first signal input terminal; and a first resistor, one terminal of the first resistor being electrically connected with the first signal input terminal, and another terminal of the first resistor being electrically connected with the second signal input terminal.

In one embodiment, the judgment branch includes a comparator, a positive input terminal of the comparator is electrically connected with the first signal input terminal, the negative input terminal of the comparator is electrically connected with the first resistor and the second signal input terminal, and a comparison signal output terminal of the comparator is electrically connected with the first input terminal of the feedback circuit.

In one embodiment, the feedback circuit includes:

an adjustment branch electrically connected with the voltage output terminal of the drive chip through the first input terminal of the feedback circuit, and electrically connected with the feedback voltage input terminal of the drive chip through the first output terminal of the feedback circuit, the adjustment branch being configured for generating the feedback voltage according to the detection control signal and the working voltage and outputting the feedback voltage to the drive chip, thereby the drive chip adjusting the working voltage to the voltage required for the aging detection according to the feedback voltage; and a switch branch, a first input terminal of the switch branch being electrically connected with the comparison signal output terminal of the comparator, a second input terminal of the switch branch being electrically connected with the adjustment branch through the second output terminal of the adjustment branch, and an output terminal of the switch branch being electrically connected with the feedback voltage input terminal of the drive circuit and the first output terminal of the feedback circuit, the switch branch is configured for receiving the detection control signal and controlling the feedback voltage output by the adjustment branch according to the detection control signal.

In one embodiment, the switch branch includes:

a switch tube, a gate of the switch tube being electrically connected with the comparison signal output terminal of the comparator, a drain of the switch tube being electrically connected with the feedback voltage input terminal of the drive chip and the first output terminal of the feedback circuit, and a source of the switch tube being electrically connected with the second output terminal of the adjustment branch.

In one embodiment, the adjustment branch includes:

a second resistor, one terminal of the second resistor being electrically connected with the feedback voltage input terminal of the drive chip, and another terminal of the second resistor being grounded;

a third resistor, one terminal of the third resistor being electrically connected with the voltage output terminal of the drive chip, and another terminal of the third resistor being electrically connected with the second resistor, the feedback voltage output terminal of the drive chip and the drain of the switch tube; and a fourth resistor, one terminal of the fourth resistor being electrically connected with the source of the switch tube, and another terminal of the fourth resistor being electrically connected with the voltage output terminal of the drive chip and the third resistor.

As such, embodiments of that present application provide a drive circuit and a display panel. The drive circuit includes a drive chip, a detection signal generation circuit and a feedback circuit. The drive chip is configured for outputting a working voltage. The detection signal generation circuit is configured for receiving a first voltage signal and a second voltage signal, and generating a detection control signal for performing an aging detection according to the first voltage signal and the second voltage signal. A first input terminal of the feedback circuit is electrically connected with a voltage output terminal of the drive chip, a second input terminal of the feedback circuit is electrically connected with an output terminal of the detection signal generation circuit, and a first output terminal of the feedback circuit is electrically connected with the feedback voltage input terminal of the drive chip. The feedback circuit is configured for receiving the detection control signal output by the detection signal generation circuit and the working voltage provided by the drive chip, generating a feedback voltage according to the detection control signal and the working voltage, and outputting the feedback voltage to the drive chip, so that the drive chip adjusts the working voltage to a voltage required for the aging detection according to the feedback voltage. In the drive circuit capable of performing the aging detection provided in the present application, a detection control signal for performing the aging detection can be generated by the detection signal generation circuit, so that the feedback circuit adjusts the voltage output by the drive chip to a voltage required for the aging detection according to the detection control signal. It is convenient to raise the voltage according to actual needs in the aging detection to meet needs of the aging detection and to meet the diversity requirements of voltage required for the aging detection voltage in the aging detection process.

DETAILED DESCRIPTION OF THE EMBODIMENTS

In order to make the above purposes, features and advantages of the present application more apparent and understandable, a detailed description of specific embodiments of the present application are given below in conjunction with the drawings. Many specific details are set forth in the following description to facilitate a full understanding of the present application. However, this application can be implemented in many other ways different from those described herein. Those skilled in the art can make similar modifications without departing from the connotation of this application, and this application is not limited by the specific implementation disclosed below.

Figure 1:
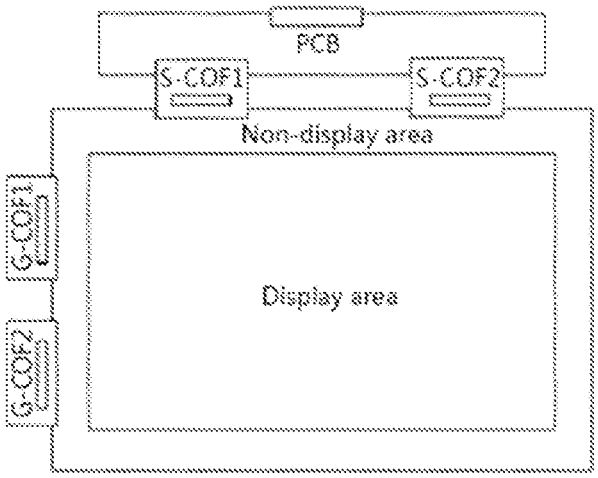
FIG. 1 is a schematic diagram of an electrical structure of an exemplary display panel.

TFT-LCD display panel is one of the main products of flat panel display at present, and has become an important display platform in modern information technology industry and video products. Referring to FIG. 1, a main drive principle of a TFT-LCD display panel includes: a main board of the system connects data such as pixel signals, control signals and power sources with connectors on the printed circuit board (PCB) through wires, the data are processed by a Timing Controller (TCON) integrated circuit on the PCB board, and then connected to a display area through a source-chip on film (S-COF) and a gate-chip on film (G-COF), so that the display area can obtain the required power supply and data to realize image display.

However in a process of production, the display panel is prone to liquid crystal cell line defects, slight damages to electronic components and other problems. Those problems easily lead to defects of the display panel, such as wire breakage, corrosion and the like, which seriously affect the quality of the product. Therefore, an aging detection is required to test whether those problems exist after the manufacturing process of the display panel is completed. However, the conventional aging detection design can no longer meet customers' demand for the diversity of voltages used in the aging detection process.

Figure 2:
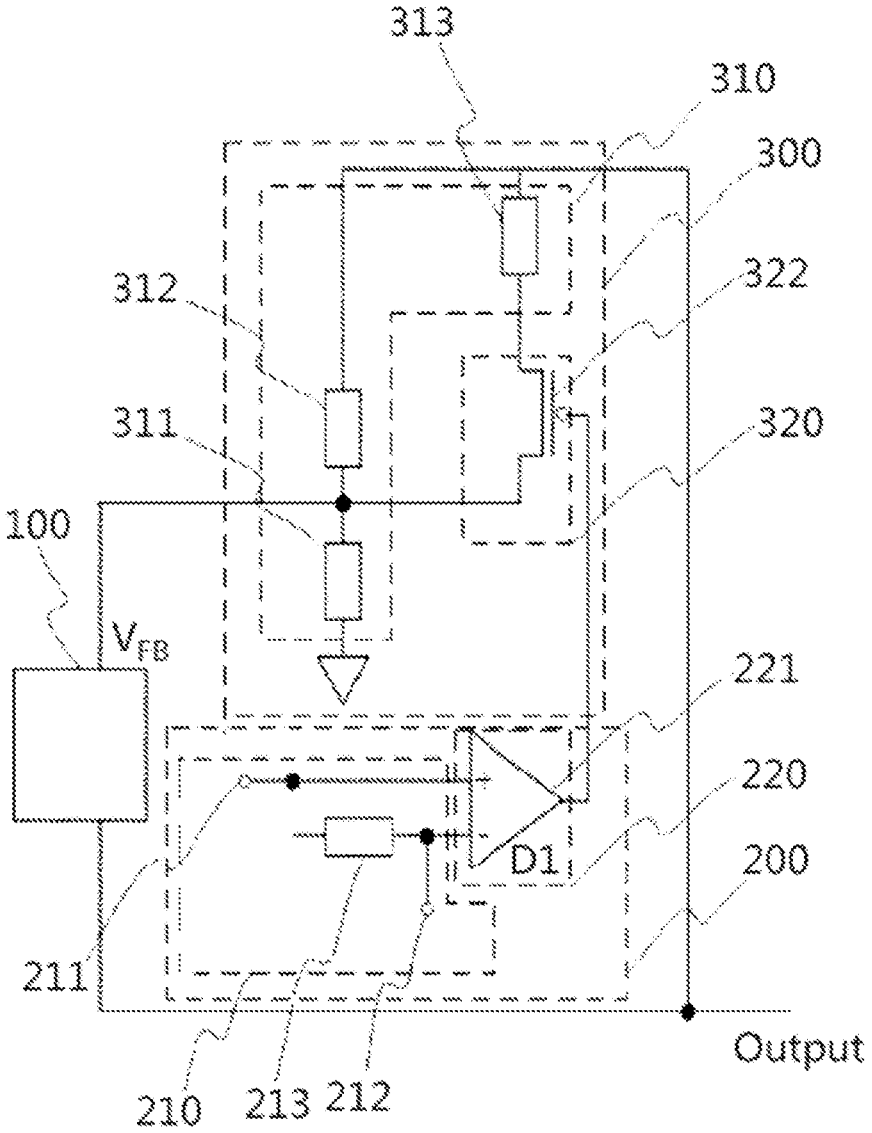
FIG. 2 is a schematic diagram of a circuit structure of a drive circuit provided in an embodiment of the present application.

In view of the above problems, embodiments of the present application provide a drive circuit. Referring to FIG. 2, the drive circuit includes a drive chip 100, a detection signal generation circuit 200, and a feedback circuit 300.

It should be understood that, the drive chip 100 is configured to output a working voltage. The detection signal generation circuit 200 is configured to receive a first voltage signal and a second voltage signal, generate a detection control signal for performing an aging detection according to the first voltage signal and the second voltage signal. A first input terminal of the feedback circuit 300 is electrically connected to a voltage output terminal of the drive chip 100, a second input terminal of the feedback circuit 300 is electrically connected to an output terminal of the detection signal generation circuit 200, and a first output terminal of the feedback circuit 300 is electrically connected to a feedback voltage input terminal of the drive chip 100. The feedback circuit 300 is configured for receiving the detection control signal output by the detection signal generation circuit 200 and the working voltage supplied by the drive chip 100, generating a feedback voltage according to the detection control signal and the working voltage and output the feedback voltage to the drive chip 100, so that the drive chip 100 adjusts the working voltage to a voltage required for the aging detection according to the feedback voltage.

It should be understood that, in the drive circuit provided in the present embodiment, a detection control signal for performing aging detection can be generated by the detection signal generation circuit 200, so that the feedback circuit 300 adjusts a voltage output by the drive chip 100 to that required for the aging detection according to the detection control signal, so that the voltage can be increased according to actual requirements in the aging detection to meet the needs of the aging detection.

In one embodiment, the detection signal generation circuit 200 includes a voltage input branch 210 and a judgment branch 220. The voltage input branch 210 is configured to receive the first voltage signal and the second voltage signal. The judgment branch 220 is electrically connected with the voltage input branch 210. The first voltage signal and the second voltage signal are input to the judgment branch 220 through the voltage input branch 210, and the judgment branch 220 generates the detection control signal according to the first voltage signal and the second voltage signal.

In one embodiment, the voltage input branch 210 includes a first signal input terminal 211, a second signal input terminal 212, and a first resistor 213. The first signal input terminal 211 is electrically connected to the judgment branch 220. The second signal input terminal 212 is electrically connected to the judgment branch 220 and the first signal input terminal. One terminal of the first resistor 213 is electrically connected with the first signal input terminal, and the other terminal of the first resistor 213 is electrically connected with the second signal input terminal.

It should be understood that, in this embodiment that first voltage signal is received through the first signal input terminal 211 and the second input signal is receive through the second signal input terminal 212. When a aging detection is required, the first voltage signal and the second voltage signal are respectively input through the first signal input terminal 211 and the second signal input terminal 212, so that an aging detection process can be carried out, and the aging detection of the display panel is convenient.

In one embodiment, the judgment branch 220 includes a comparator 221, a positive input terminal of the comparator 221 is electrically connected to the first signal input terminal 211, a negative input terminal of the comparator 221 is electrically connected to the first resistor 213 and the second signal input terminal 212, and a comparison signal output terminal of the comparator 221 is electrically connected to the second input terminal of the feedback circuit 300.

It should be understood that, in this embodiment, the positive input terminal of the comparator 221 is connected to the first signal input terminal 211, and the negative input terminal of the comparator 221 is connected to the second signal input terminal 212, so that the comparator 221 receives the first voltage signal and the second voltage signal through the positive input terminal and the negative input terminal, respectively. The first voltage signal and the second voltage signal are compared by the comparator 221, and a high level or a low level detection control signal is output at the comparison signal output terminal of the comparator 221.

In one embodiment, the feedback circuit 300 includes an adjustment branch 310 and a switch branch 320. The adjustment branch 310 is electrically connected to the voltage output terminal of the drive chip 100 through the first input terminal of the feedback circuit 300. The adjustment branch is electrically connected with the feedback voltage input terminal of the drive chip 100 through the first output terminal of the feedback circuit 300. The adjustment branch 310 is configured for generating the feedback voltage according to the detection control signal and the working voltage and outputting the feedback voltage to the drive chip 100, so that the drive chip 100 adjusts the working voltage to a voltage required for performing an aging detection based on the feedback voltage. A first input terminal of the switch branch 320 is electrically connected to the comparison signal output terminal of the comparator 221, a second input terminal of the switch branch 320 is electrically connected to the adjustment branch 310 through the second output terminal of the feedback circuit 300, and an output terminal of the switch branch 320 is electrically connected with the feedback voltage input terminal of the drive circuit 100 and the first output terminal of the feedback circuit 300. The switch branch 320 is configured for receiving the detection control signal and controlling the feedback voltage output by the adjustment branch 310 according to the detection control signal.

In one embodiment, the switch branch 320 includes a switch tube 321. A gate of the switch tube 321 is electrically connected to the comparison signal output terminal of the comparator 221, a drain of the switch tube 321 is electrically connected to the feedback voltage input terminal of the drive chip 100 and the first output terminal of the feedback circuit 300, and a source of the switch tube 321 is electrically connected to the second output terminal of the adjustment branch 310. The source of the switch tube 321 is connected to the adjustment branch 310. It should be noted that the first output terminal of the adjustment branch 310 in this embodiment is also the first output terminal of the feedback circuit 300.

In one embodiment, the adjustment branch 310 includes a second resistor 311, a third resistor 312, and a fourth resistor 313. One terminal of the second resistor 311 is electrically connected to the feedback voltage input terminal of the drive chip 100, and the other terminal of the second resistor 311 is grounded. One terminal of the third resistor 312 is electrically connected to the voltage output terminal of the drive chip 100, and the other terminal of the third resistor 312 is electrically connected to the second resistor 311, the feedback voltage output terminal of the drive chip 100, and the drain of the switch tube 321. One terminal of the fourth resistor 313 is electrically connected to the source of the switch tube 321, and the other terminal of the fourth resistor 313 is connected to the voltage output terminal of the drive chip 100 and the third resistor 312.

In one embodiment, the first voltage signal is a high level voltage signal, the second voltage signal is a low level voltage signal, and the switch tube 321 is a P-type switch tube 321.

It should be understood that, during the aging detection, when the first voltage signal is a high level voltage signal, and the second voltage signal is a low voltage level voltage signal, the positive input terminal of the comparator 221 receives the high level voltage signal and the negative input terminal of the comparator 221 receives the low level voltage signal. Therefore, the detection control signal output by the comparator 221 through the comparison signal output terminal is a high level signal, and the P-type switch tube 321 is turned on to adjust the voltage output by the drive chip 100 to the voltage required for the aging detection.

In one embodiment, the switch tube 321 is a triode or a FET. In addition, the switch tube 321 can also be replaced by a component with switching characteristics, such as a relay.

In this embodiment, the switch tube 321 is a P-type FET. When a gate voltage of the switch tube 321 is low, the switch tube 321 is turned on, and when the gate voltage of the switch tube 321 is high, the switch tube 321 is turned off. When a voltage of the positive input terminal of the comparator 221 is higher than a voltage of the negative input terminal of the comparator 221, the detection control signal output by the comparator 221 is a high level signal; when the voltage of the positive input terminal of the comparator 221 is higher than the voltage of the negative input terminal, the detection control signal output by the comparator 221 is a high level signal. The voltage output from the voltage output terminal of the drive chip 100 is the working voltage actually supplied to the display area. A threshold value of the feedback voltage VFB of the drive chip 100 is 1.25 V. When the feedback voltage received by the drive chip 100 is lower than 1.25 V, the drive chip 100 automatically increases the output voltage according to the feedback voltage.

When the drive circuit is operating normally, the second signal input terminal 212 is suspended and the first voltage signal VDD is 3.5 V. There is no current passing through the first resistor 213, and the first resistor 213 is equivalent to a conducting line, that is, the voltages of the positive input terminal and the negative input terminal of the comparator 221 are equal and both are 3.5 V. The detection control signal output by the comparator 221 is a low level voltage signal, the gate of the switch tube 321 is also at a low level, and the switch tube 321 is turned on. At this time, the output voltage VI of the drive chip 100 is 1.25*(Ra+R2)/R2, where Ra=R3*R4/(R3+R4), R1 is a resistance value of the first resistor 213, R2 is a resistance value of the second resistor 311, R3 is a resistance value of the third resistor 312, and R4 is a resistance value of the fourth resistor 313.

When an aging detection is required, the second voltage signal is input through the second signal input terminal 212. The second voltage signal is a low level signal, that is, the second signal input terminal 212 is grounded, the positive input terminal of the comparator 221 is 3.5 V, thus the detection control signal output by the comparator 221 is a high level signal. The gate of the switch tube 321 is at a high level, and the switch tube 321 is turned off. At this time, the output voltage V2 of the drive chip 100 is equal to 1.25*(R2+R3)/R2. Moreover, according to the formula, V2>V1.

It can be seen that in this embodiment, the actual output voltage of the drive circuit can be increased by adjusting the resistance value of each resistor in the feedback circuit 300 to meet the customer's requirement for increasing the working voltage in the aging detection process.

Figure 3:
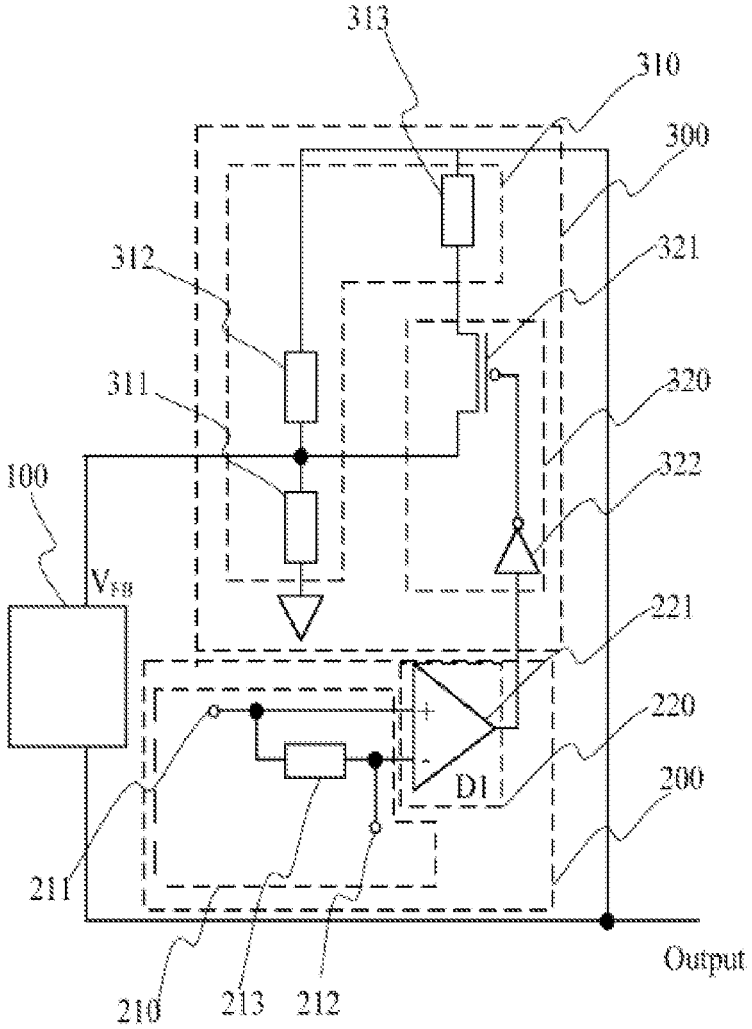
FIG. 3 is a schematic diagram of a circuit structure of another drive circuit provided in an embodiment of the present application.

In some embodiments, the switch tube 321 may also be an N-type switch tube, referring to FIG. 3. In this embodiment, the switch branch 320 includes a switch tube 321 and an inverter 322.

An input terminal of the inverter 322 is electrically connected to the signal output terminal of the comparator 221, and an output terminal of the inverter 322 is connected to a gate of the switch tube 321.

The gate of the switch tube 321 is electrically connected to the output terminal of the inverter, a source of the switch tube 321 is electrically connected to the feedback voltage input terminal of the drive chip 100 and the first output terminal of the feedback circuit 300, and a drain of the switch tube 321 is electrically connected to the second output terminal of the adjustment branch 310

The adjustment branch 310 includes a second resistor 311, a third resistor 312, and a fourth resistor 313. One terminal of the second resistor 311 is electrically connected to the feedback voltage input terminal of the drive chip 100, and the other terminal of the second resistor 311 is grounded. One terminal of the third resistor 312 is electrically connected to the voltage output terminal of the drive chip 100, and the other terminal of the third resistor 312 is electrically connected to the second resistor 311, the feedback voltage output terminal of the drive chip 100, and the drain of the switch tube 321. One terminal of the fourth resistor 313 is electrically connected to the source of the switch tube 321, and the other terminal of the fourth resistor 313 is connected to the voltage output terminal of the drive chip 100 and the third resistor 312. It should be understood that, in this embodiment, the first voltage signal is a high level voltage signal, the second voltage signal is a low level voltage signal, and the switch tube is an N-type switch tube.

Figure 4:
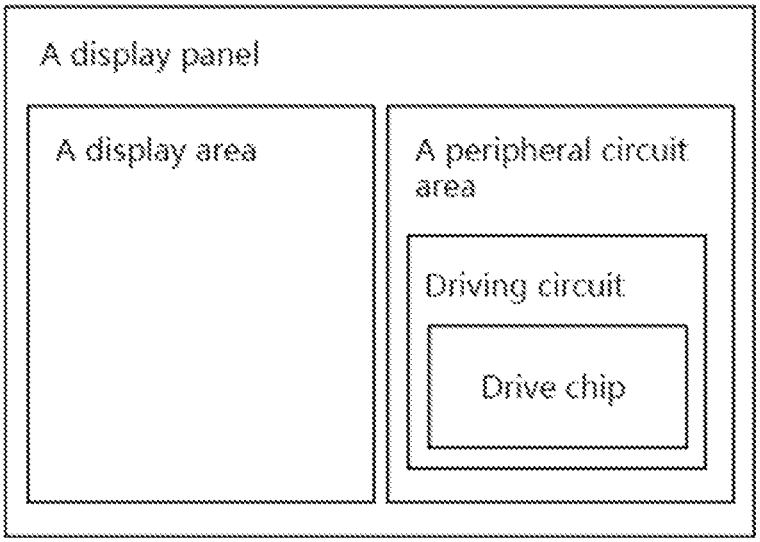
FIG. 4 is a schematic diagram of a structure of a display panel of the present application.

According to FIG. 4, based on a same inventive concept, the present application also provides a display panel, the display panel includes:

a display area for displaying according to the drive signal;

a peripheral circuit area electrically connected with the display area for supplying power to the display area and providing the drive signal;

the peripheral circuit area includes a drive circuit including a drive chip 100, a detection signal generation circuit 200, and a feedback circuit 300;

the drive chip 100 is configured for outputting a working voltage;

the detection signal generation circuit 200 is configured for receiving a first voltage signal and a second voltage signal, and generate a detection control signal for performing an aging detection based on the first voltage signal and the second voltage signal; and a first input terminal of the feedback circuit 300 is electrically connected to the voltage output terminal of the drive chip, a second input terminal of the feedback circuit 300 is electrically connected with an output terminal of the detection signal generation circuit, and a first output terminal of the feedback circuit is electrically connected with the feedback voltage input terminal of the drive chip 100, the feedback circuit 300 is configured for receiving the detection control signal output by the detection signal generation circuit 200 and the working voltage provided by the drive chip 100, generating a feedback voltage according to the detection control signal and the working voltage and output the feedback voltage to the drive chip 100, so that the drive chip 100 adjusts the working voltage to a voltage required for an aging detection according to the feedback voltage.

In one embodiment, the detection signal generation circuit 200 includes a voltage input branch 210 and an judgment branch 220.

The voltage input branch 210 is configured to receive the first voltage signal and the second voltage signal.

The judgment branch 220 is electrically connected with the voltage input branch 210. The first voltage signal and the second voltage signal are input to the judgment branch 220 through the voltage input branch 210, and the judgment branch 220 generates the detection control signal according to the first voltage signal and the second voltage signal.

In one embodiment, the voltage input branch 210 includes a first signal input terminal 211, a second signal input terminal 212, and a first resistor 213. The first signal input terminal 211 is electrically connected to the judgment branch 220. The second signal input terminal 212 is electrically connected to the judgment branch 220 and the first signal input terminal. One terminal of the first resistor 213 is electrically connected with the first signal input terminal, and the other terminal of the first resistor 213 is electrically connected with the second signal input terminal.

In one embodiment, the judgment branch 220 includes a comparator 221, a positive input terminal of the comparator 221 is electrically connected to the first signal input terminal 211, a negative input terminal of the comparator 221 is electrically connected to the first resistor 213 and the second signal input terminal 212, and a comparison signal output terminal of the comparator 221 is electrically connected to the first input terminal of the feedback circuit 300.

In one embodiment, the feedback circuit 300 includes an adjustment branch 310 and a switch branch 320. The adjustment branch 310 is electrically connected to the voltage output terminal of the drive chip 100 through the first input terminal of the feedback circuit 300. The adjustment branch is electrically connected with the feedback voltage input terminal of the drive chip 100 through the first output terminal of the feedback circuit 300. The adjustment branch 310 is configured for generating the feedback voltage according to the detection control signal and the working voltage and outputting the feedback voltage to the drive chip 100, so that the drive chip 100 adjusts the working voltage to a voltage required for performing an aging detection based on the feedback voltage. A first input terminal of the switch branch 320 is electrically connected to the comparison signal output terminal of the comparator 221, a second input terminal of the switch branch 320 is electrically connected to the adjustment branch 310 through the second output terminal of the feedback circuit 300, and an output terminal of the switch branch 320 is electrically connected with the feedback voltage input terminal of the drive circuit 100 and the first output terminal of the feedback circuit 300. The switch branch 320 is configured for receiving the detection control signal and controlling the feedback voltage output by the adjustment branch 310 according to the detection control signal.

In one embodiment, the switch branch 320 includes a switch tube 321. A gate of the switch tube 321 is electrically connected to the comparison signal output terminal of the comparator 221, a drain of the switch tube 321 is electrically connected to the feedback voltage input terminal of the drive chip 100 and the first output terminal of the feedback circuit 300, and a source of the switch tube 321 is electrically connected to the second output terminal of the adjustment branch 310. The source of the switch tube 321 is connected to the adjustment branch 310. It should be noted that the first output terminal of the adjustment branch 310 in this embodiment is also the first output terminal of the feedback circuit 300.

In one embodiment, the adjustment branch 310 includes a second resistor 311, a third resistor 312, and a fourth resistor 313. One terminal of the second resistor 311 is electrically connected to the feedback voltage input terminal of the drive chip 100, and the other terminal of the second resistor 311 is grounded. One terminal of the third resistor 312 is electrically connected to the voltage output terminal of the drive chip 100, and the other terminal of the third resistor 312 is electrically connected to the second resistor 311, the feedback voltage output terminal of the drive chip 100, and the drain of the switch tube 321. One terminal of the fourth resistor 313 is electrically connected to the source of the switch tube 321, and the other terminal of the fourth resistor 313 is connected to the voltage output terminal of the drive chip 100 and the third resistor 312.

As such, embodiments of that present application provide a drive circuit and a display panel. The drive circuit includes a drive chip 100, a detection signal generation circuit 200, and a feedback circuit 300. The detection signal generation circuit 200 is configured to receive a first voltage signal and a second voltage signal, and generate a detection control signal for performing an aging detection according to the first voltage signal and the second voltage signal. The feedback circuit 300 is configured to receive the detection control signal output from the detection signal generation circuit 200, and adjust the voltage output from the drive chip 100 to a voltage required for performing the aging detection according to the detection control signal. In the drive circuit capable of performing the aging detection provided in the present application, a detection control signal for performing the aging detection can be generated by the detection signal generation circuit 200, so that the feedback circuit 300 adjusts the voltage output by the drive chip 100 to a voltage required for the aging detection according to the detection control signal. It is convenient to raise the voltage according to actual needs in the aging detection to meet needs of the aging detection and to meet the diversity requirements of voltage required for the aging detection voltage in the aging detection process.

The technical features of the above-described embodiments can be combined arbitrarily, and not all possible combinations of the technical features of the above-described embodiments have been described for the sake of simplicity of description. However, as long as there is no contradiction between the combinations of these technical features, it should be considered the combinations fall in the scope of this specification.

The above-described embodiments only illustrate several embodiments of the present application, and the description is relatively specific and detailed. However, this cannot be understood as limiting the scope of the application. It should be noted that, for those of ordinary skilled in the art, a number of variations and modifications can be made without departing from the concept of the present application, and all of those variations and modifications fall within the scope of protection of the present application. Therefore, the scope of protection of the application shall be subject to the appended claims.

What is claimed is:

1. A drive circuit comprising:

a drive chip for outputting a working voltage;

a detection signal generation circuit comprising:

a voltage input branch comprising:

a first signal input terminal for receiving a first voltage signal, wherein the first voltage signal is a high level voltage signal;

a second signal input terminal changeable between a state of being suspended and another state of receiving a second voltage signal, wherein the second voltage signal is a low level voltage signal; and a first resistor having one terminal electrically connected with the first signal input terminal, and another terminal electrically connected with the second signal input terminal; and an adjustment branch comprising:

a comparator, comprising:

a positive input terminal electrically connected with the first signal input terminal;

a negative input terminal electrically connected with the first resistor and the second signal input terminal; and a comparison signal output terminal for outputting a detection control signal;

wherein the comparator is configured for comparing the first voltage signal received from the first signal input terminal and a voltage received from the second input terminal and outputting the detection control signal according, and a feedback circuit, a first input terminal of the feedback circuit being electrically connected with a voltage output terminal of the drive chip, a second input terminal of the feedback circuit being electrically connected with the comparison signal output terminal, and a first output terminal of the feedback circuit being electrically connected with a feedback voltage input terminal of the drive chip, the feedback circuit being configured for receiving the detection control signal output by the comparison signal output terminal and the working voltage provided by the drive chip, generating a feedback voltage according to the detection control signal and the working voltage and outputting the feedback voltage to the drive chip wherein when the second signal input terminal is in the state of being suspended, the detection control signal output by the comparison signal output terminal is a low level voltage signal, the feedback circuit is configured for generating the feedback voltage according to the low level voltage signal output by the comparison signal output terminal and the working voltage, and outputting the feedback voltage to the drive chip, thereby the working voltage output by the drive chip is a first voltage V1, wherein when the second signal input terminal is in the another state of receiving the second voltage signal, the detection control signal output by the comparison signal output terminal is a high level voltage signal, the feedback circuit is configured for generating the feedback voltage according to the high level voltage signal output by the comparison signal output terminal and the working voltage, and outputting the feedback voltage to the drive chip, thereby the working voltage output by the drive chip is changed from the first voltage V1 to a second voltage required for the aging detection;

wherein the feedback circuit comprises:

an adjustment branch electrically connected with the voltage output terminal of the drive chip through the first input terminal of the feedback circuit, and electrically connected with the feedback voltage input terminal of the drive chip through the first output terminal of the feedback circuit, the adjustment branch being configured for generating the feedback voltage according to the detection control signal and the working voltage and outputting the feedback voltage to the drive chip; and a switch branch, a first input terminal of the switch branch being electrically connected with the comparison signal output terminal of the comparator, a second input terminal of the switch branch being electrically connected with the adjustment branch through a second output terminal of the adjustment branch, and an output terminal of the switch branch being electrically connected with the feedback voltage input terminal of the drive circuit and the first output terminal of the feedback circuit, the switch branch is configured for receiving the detection control signal and controlling the feedback voltage output by the adjustment branch according to the detection control signal;

wherein the switch branch comprises a switch tube, a gate of the switch tube is electrically connected with the comparison signal output terminal of the comparator, a drain of the switch tube is electrically connected with the feedback voltage input terminal of the drive chip and the first output terminal of the feedback circuit, and a source of the switch tube is electrically connected with the second output terminal of the adjustment branch;

wherein the adjustment branch comprises:

a second resistor, one terminal of the second resistor being electrically connected with the feedback voltage input terminal of the drive chip, and another terminal of the second resistor being grounded;

a third resistor, one terminal of the third resistor being electrically connected with the voltage output terminal of the drive chip, and another terminal of the third resistor being electrically connected with the second resistor, the feedback voltage output terminal of the drive chip and the drain of the switch tube; and a fourth resistor, one terminal of the fourth resistor being electrically connected with the source of the switch tube, and another terminal of the fourth resistor being electrically connected with the voltage output terminal of the drive chip and the third resistor.

2. A display panel comprising:

a display area for displaying according to a drive signal, and a peripheral circuit area electrically connected with the display area for supplying power to the display area and providing the drive signal;

wherein the peripheral circuit area comprises a driving circuit, the driving circuit comprises:

a drive chip for outputting a working voltage;

a detection signal generation circuit comprising:

a voltage input branch comprising:

a first signal input terminal for receiving a first voltage signal, wherein the first voltage signal is a high level voltage signal;

a second signal input terminal changeable between a state of being suspended and another state of receiving a second voltage signal, wherein the second voltage signal is a low level voltage signal; and a first resistor having one terminal electrically connected with the first signal input terminal, and another terminal electrically connected with the second signal input terminal; and an adjustment branch comprising:

a comparator, comprising:

a positive input terminal electrically connected with the first signal input terminal;

a negative input terminal electrically connected with the first resistor and the second signal input terminal; and a comparison signal output terminal for outputting a detection control signal;

wherein the comparator is configured for comparing the first voltage signal received from the first signal input terminal and a voltage received from the second input terminal and outputting the detection control signal according, and a feedback circuit, a first input terminal of the feedback circuit being electrically connected with a voltage output terminal of the drive chip, a second input terminal of the feedback circuit being electrically connected with the comparison signal output terminal, and a first output terminal of the feedback circuit being electrically connected with a feedback voltage input terminal of the drive chip, the feedback circuit being configured for receiving the detection control signal output by the comparison signal output terminal and the working voltage provided by the drive chip, generating a feedback voltage according to the detection control signal and the working voltage and outputting the feedback voltage to the drive chip, wherein when the second signal input terminal is in the state of being suspended, the detection control signal output by the comparison signal output terminal is a low level voltage signal, the feedback circuit is configured for generating the feedback voltage according to the low level voltage signal output by the comparison signal output terminal and the working voltage, and outputting the feedback voltage to the drive chip, thereby the working voltage output by the drive chip is a first voltage V1, wherein when the second signal input terminal is in the another state of receiving the second voltage signal, the detection control signal output by the comparison signal output terminal is a high level voltage signal, the feedback circuit is configured for generating the feedback voltage according to the high level voltage signal output by the comparison signal output terminal and the working voltage, and outputting the feedback voltage to the drive chip, thereby the working voltage output by the drive chip is changed from the first voltage V1 to a second voltage required for the aging detection;

wherein the feedback circuit comprises:

an adjustment branch electrically connected with the voltage output terminal of the drive chip through the first input terminal of the feedback circuit, and electrically connected with the feedback voltage input terminal of the drive chip through the first output terminal of the feedback circuit, the adjustment branch being configured for generating the feedback voltage according to the detection control signal and the working voltage and outputting the feedback voltage to the drive chip; and a switch branch, a first input terminal of the switch branch being electrically connected with the comparison signal output terminal of the comparator, a second input terminal of the switch branch being electrically connected with the adjustment branch through a second output terminal of the adjustment branch, and an output terminal of the switch branch being electrically connected with the feedback voltage input terminal of the drive circuit and the first output terminal of the feedback circuit, the switch branch is configured for receiving the detection control signal and controlling the feedback voltage output by the adjustment branch according to the detection control signal;

wherein the switch branch comprises:

a switch tube, a gate of the switch tube being electrically connected with the comparison signal output terminal of the comparator, a drain of the switch tube being electrically connected with the feedback voltage input terminal of the drive chip and the first output terminal of the feedback circuit, and a source of the switch tube being electrically connected with the second output terminal of the adjustment branch;

wherein the adjustment branch comprises:

a second resistor, one terminal of the second resistor being electrically connected with the feedback voltage input terminal of the drive chip, and another terminal of the second resistor being grounded;

a third resistor, one terminal of the third resistor being electrically connected with the voltage output terminal of the drive chip, and another terminal of the third resistor being electrically connected with the second resistor, the feedback voltage output terminal of the drive chip and the drain of the switch tube; and a fourth resistor, one terminal of the fourth resistor being electrically connected with the source of the switch tube, and another terminal of the fourth resistor being electrically connected with the voltage output terminal of the drive chip and the third resistor.

* * * * *